US008756734B1

(12) United States Patent
Ortega

(10) Patent No.: US 8,756,734 B1
(45) Date of Patent: Jun. 24, 2014

(54) PILLOW DEVICE

(71) Applicant: Sandra E. Ortega, Enid, OK (US)

(72) Inventor: Sandra E. Ortega, Enid, OK (US)

( * ) Notice: Subject to any disclaimer, the term of this patent is extended or adjusted under 35 U.S.C. 154(b) by 0 days.

(21) Appl. No.: 14/019,643

(22) Filed: Sep. 6, 2013

(51) Int. Cl.
*A47G 9/10* (2006.01)

(52) U.S. Cl.
USPC ..... 5/636; 5/632; 5/490

(58) Field of Classification Search
USPC ..... 5/636, 632, 630, 639, 640, 645, 646, 5/490
See application file for complete search history.

(56) References Cited

U.S. PATENT DOCUMENTS

| | | | | | |
|---|---|---|---|---|---|
| 2,782,427 | A * | 2/1957 | Ericson | ..... | 5/632 |
| 3,555,582 | A * | 1/1971 | Radford | ..... | 5/632 |
| 5,054,143 | A | 10/1991 | Javaher | | |
| 5,479,667 | A * | 1/1996 | Nelson et al. | ..... | 5/636 |
| 5,906,205 | A | 5/1999 | Hiebert | | |
| 6,065,166 | A | 5/2000 | Sharrock et al. | | |
| D561,511 | S | 2/2008 | Peart | | |
| 7,861,720 | B1 | 1/2011 | Wolcott | | |
| 7,908,691 | B2 * | 3/2011 | Small | ..... | 5/632 |
| 8,065,766 | B1 | 11/2011 | Fierro | | |
| 8,069,515 | B1 | 12/2011 | Tingey | | |
| 8,291,534 | B2 | 10/2012 | Karlson | | |
| 2008/0134437 | A1 * | 6/2008 | Small | ..... | 5/632 |
| 2011/0296615 | A1 * | 12/2011 | Tingey | ..... | 5/632 |
| 2012/0144591 | A1 | 6/2012 | Mobley et al. | | |
| 2012/0174320 | A1 | 7/2012 | White Thomas et al. | | |

* cited by examiner

*Primary Examiner* — Robert G Santos

(57) ABSTRACT

A pillow device supports a person's head without pinching of nerves or arteries. The device includes an envelope and a filling positioned in the envelope wherein the envelope and filling define a pillow. A main section of the pillow has a top surface, a bottom surface, and a perimeter edge. A projection of the pillow extends from the perimeter edge and the filling extends into the projection. The projection is substantially L-shaped wherein a distal section of the projection is configured for positioning under an arm of a user when a head of the user is positioned on the main section of the pillow.

16 Claims, 3 Drawing Sheets

PILLOW DEVICE

BACKGROUND OF THE DISCLOSURE

Field of the Disclosure

The disclosure relates to pillow devices and more particularly pertains to a new pillow device for supporting a person's head without pinching of nerves or arteries.

SUMMARY OF THE DISCLOSURE

An embodiment of the disclosure meets the needs presented above by generally comprising an envelope and a filling positioned in the envelope wherein the envelope and filling define a pillow. A main section of the pillow has a top surface, a bottom surface, and a perimeter edge. A projection of the pillow extends from the perimeter edge and the filling extends into the projection. The projection is substantially L-shaped wherein a distal section of the projection is configured for positioning under an arm of a user when a head of the user is positioned on the main section of the pillow.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
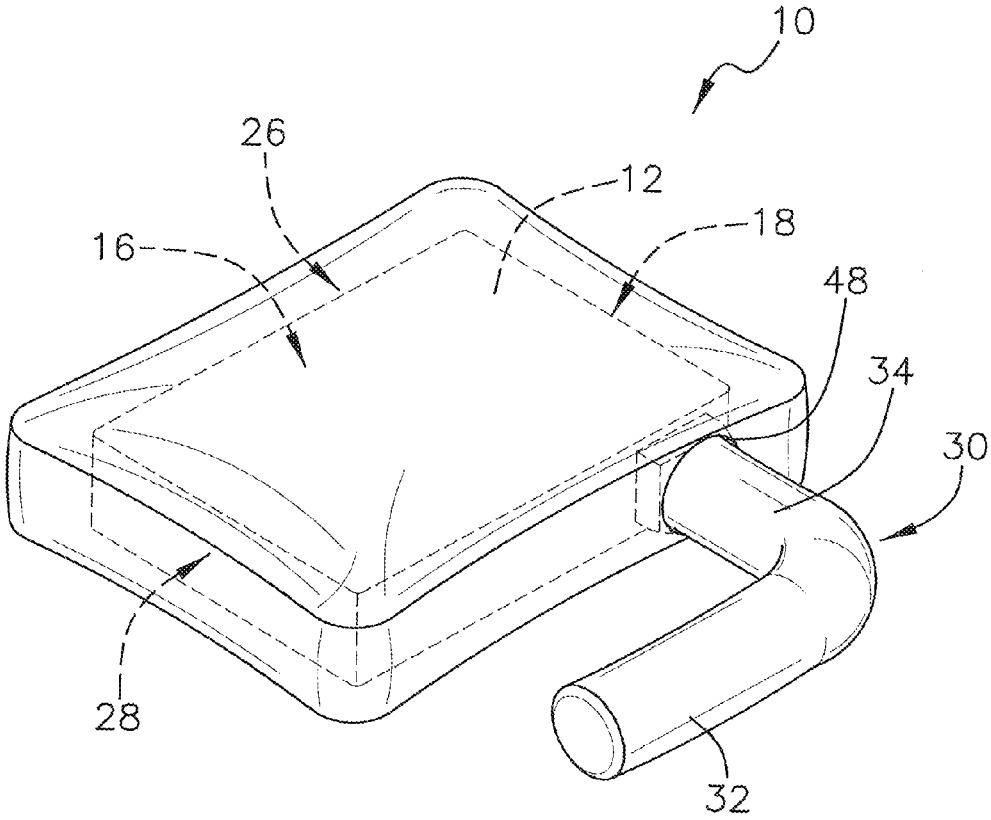
FIG. 1 is a top front side perspective view of a pillow device according to an embodiment of the disclosure.
Figure 2:
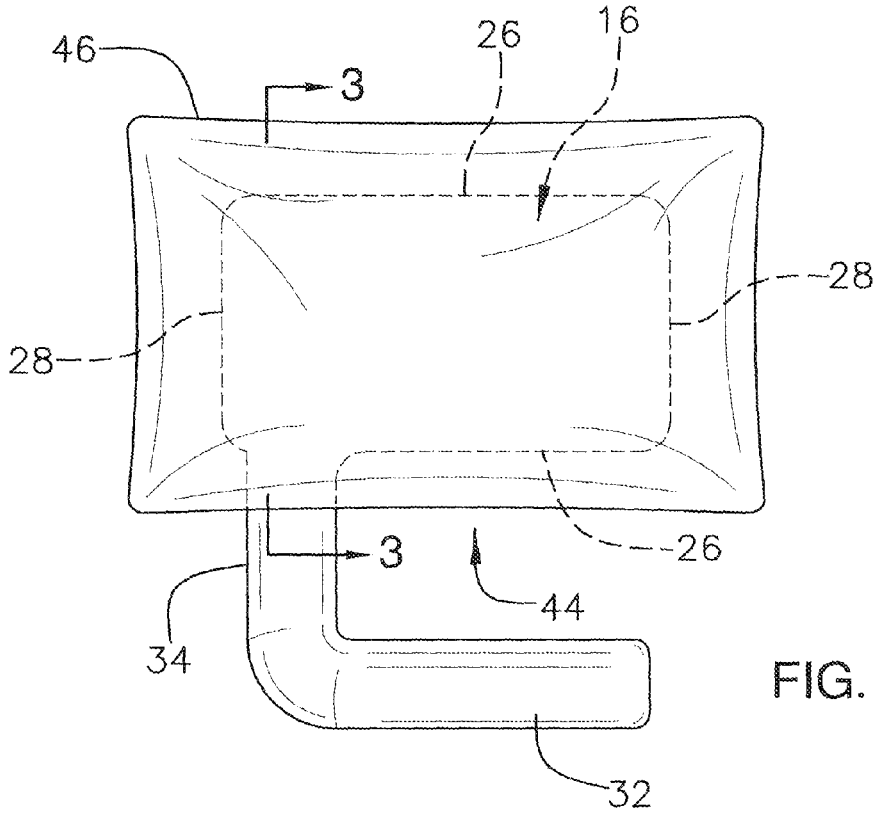
FIG. 2 is a bottom view of an embodiment of the disclosure.
Figure 3:
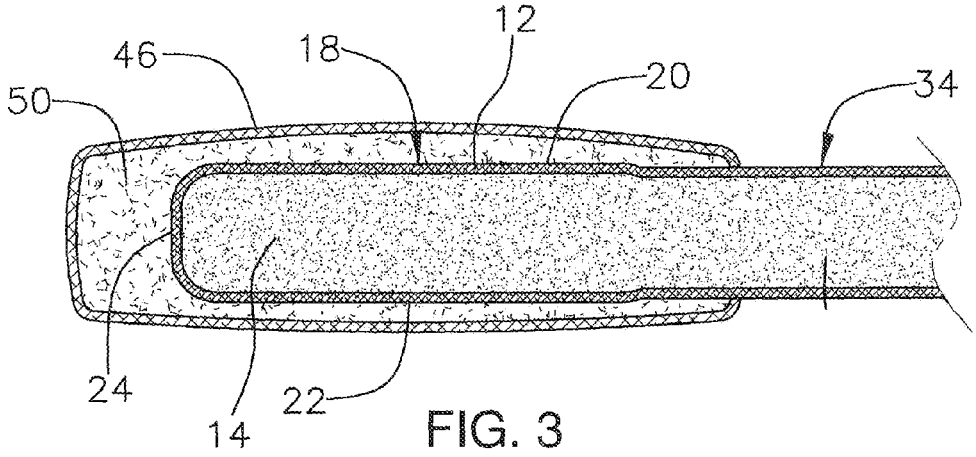
FIG. 3 is a cross-sectional view of an embodiment of the disclosure taken along line 3-3 of FIG. 2.
Figure 4:
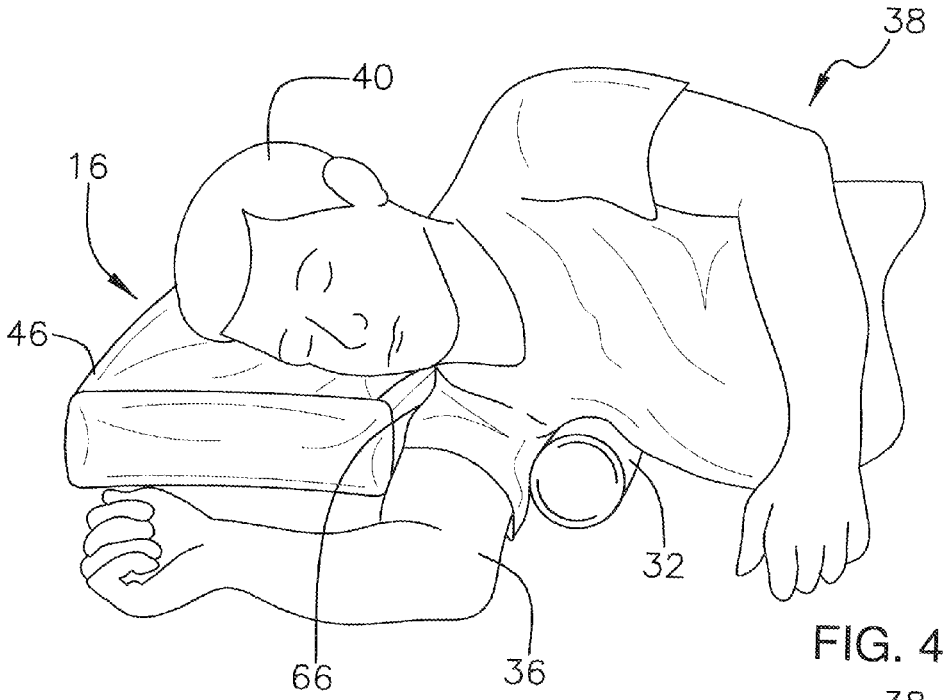
FIG. 4 is a top side perspective view of an embodiment of the disclosure in use.
Figure 5:
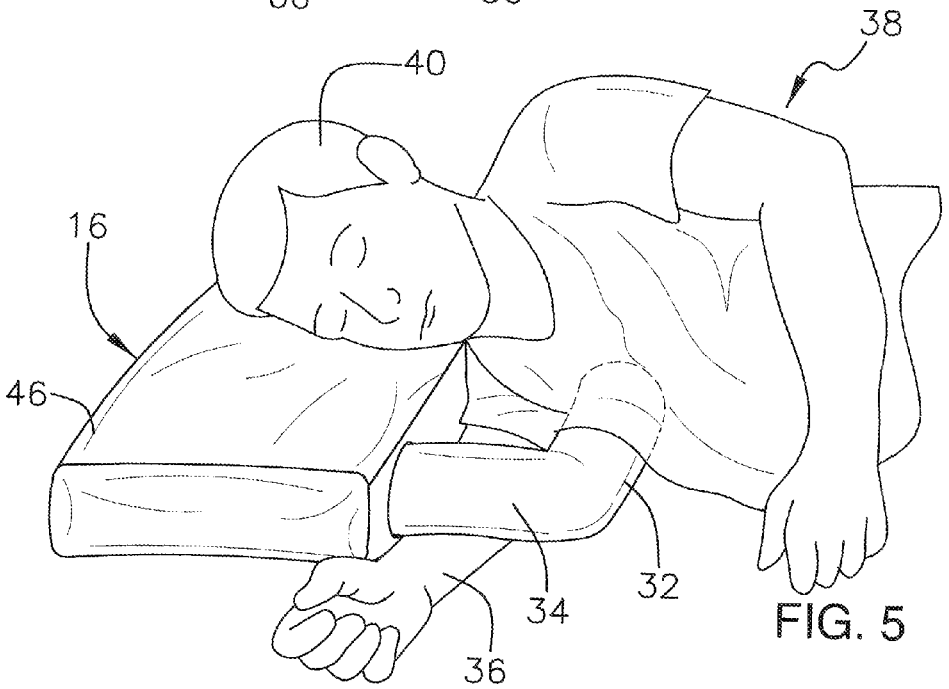
FIG. 5 is a top side perspective view of an embodiment of the disclosure in use.

With reference now to the drawings, and in particular to FIGS. 1 through 5 thereof, a new pillow device embodying the principles and concepts of an embodiment of the disclosure and generally designated by the reference numeral 10 will be described.

As best illustrated in FIGS. 1 through 5, the pillow device 10 generally comprises an envelope 12 and a first filling 14 positioned in the envelope 12 wherein the envelope 12 and filling 14 define a pillow 16. A main section 18 of the pillow 16 having a top surface 20, a bottom surface 22, and a perimeter edge 24 coupled to and extending between the top surface 20 and the bottom surface 22. The main section 18 may be substantially rectangular including being a square. The perimeter edge 24 has a pair of longitudinal sides 26 extending between opposed end sides 28.

A projection 30 of the pillow 16 extends from the perimeter edge 24 of the pillow 16. The filling 14 extends into the projection 30. The filling 14 may be a high density resilient foam or the like. The main section 18 and the projection 30 are coplanar with the projection being cylindrical having a diameter near a height of the perimeter edge 24. The projection 30 is substantially L-shaped having a distal section 32 relative to the main section 18 and a connection section 34 coupled to and extending between the distal section 32 and the perimeter edge 24. Thus, the distal section 32 of the projection 30 is configured for positioning under an arm 36 of a user 38 when a head 40 of the user 38 is positioned on or over the top surface 20 of the pillow 16. The connection section 34 extends from one of the longitudinal sides 26. The connection section 34 extends from the perimeter edge 24 proximate one of the opposed end sides 28 wherein the connection section 34 is offset from a center 44 of the one of the longitudinal sides 26. The distal section 32 of the projection 30 extends towards the center 44 of the longitudinal side 26 parallel to the longitudinal side 26.

An outer covering 46 may be coupled to and extend around the main section 18. The outer covering 46 may have a shape substantially similar to the pillow 16 absent the projection 30. The connection section 34 of the projection 30 extends outwardly through an aperture 48 in the outer covering 46. A second filling 50 is encased between the pillow 16 and the outer covering 46. The second filling 50 may be a different material such as down, feathers, batting, or the like having a density different than a density of the first filling 14.

In use, the pillow 16 is used in a substantially conventional manner with the projection 30 being positioned to extend under the user 38 such that a shoulder 66 of the user 38 is comfortably positioned between the main section 18 and the distal section 32 of the projection 30. The connection section 34 may be positioned forwardly or rearwardly of the user 38 as desired by the user 38 to enhance personal comfort.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A pillow device comprising:

an envelope;

a filling positioned in said envelope wherein said envelope defines a pillow;

a main section of said pillow having a top surface, a bottom surface, and a perimeter edge coupled to and extending between said top surface and said bottom surface;

a projection of said pillow extending from said perimeter edge of said pillow, said filling extending into said projection, said projection being substantially L-shaped having a distal section relative to said main section and a connection section coupled to and extending between said distal section and said perimeter edge wherein said distal section of said projection is configured for positioning under an arm of a user when a head of the user is supported by said main section of said pillow; and an outer covering coupled to and extending around said main section, said connection section of said projection extending outwardly through said outer covering.

2. The device of claim 1, further comprising said main section being substantially rectangular.

3. The device of claim 2, further comprising said perimeter edge having a pair of longitudinal sides extending between opposed end sides.

4. The device of claim 3, further comprising said connection section extending from one of said longitudinal sides.

5. The device of claim 4, further comprising said connection section extending from said perimeter edge proximate one of said opposed end sides wherein said connection section is offset from a center of said one of said longitudinal sides.

6. The device of claim 5, further comprising said distal section of said projection extending towards said center of said one of said longitudinal sides parallel to said one of said longitudinal sides.

7. The device of claim 1, further comprising said main section and said projection being coplanar.

8. The device of claim 1, further comprising:

said filling being a first filling: and a second filling being encased between said pillow and said outer covering, said second filling having a density different than a density of said first filling.

9. A pillow device comprising:

an envelope;

a first filling positioned in said envelope wherein said envelope and said filling define a pillow;

a main section of said pillow having a top surface, a bottom surface, and a perimeter edge coupled to and extending between said top surface and said bottom surface, said main section being substantially rectangular, said perimeter edge having a pair of longitudinal sides extending between opposed end sides;

a projection of said pillow extending from said perimeter edge of said pillow, said filling extending into said projection, said main section and said projection being coplanar, said projection being substantially L-shaped having a distal section relative to said main section and a connection section coupled to and extending between said distal section and said perimeter edge wherein said distal section of said projection is configured for positioning under an arm of a user when a head of the user is supported by said main section of said pillow, said connection section extending from one of said longitudinal sides, said connection section extending from said perimeter edge proximate one of said opposed end sides wherein said connection section is offset from a center of said one of said longitudinal sides, said distal section of said projection extending towards said center of said one of said longitudinal sides parallel to said one of said longitudinal sides;

an outer covering coupled to and extending around said main section, said connection section of said projection extending outwardly through said outer covering; and a second filling being encased between said pillow and said outer covering, said second filling having a density different than a density of said first filling.

10. A pillow device comprising:

an envelope;

a filling positioned in said envelope wherein said envelope defines a pillow;

a main section of said pillow having a top surface, a bottom surface, and a perimeter edge coupled to and extending between said top surface and said bottom surface; and a projection of said pillow extending from said perimeter edge of said pillow, said filling extending into said projection, said projection being substantially L-shaped having a distal section relative to said main section and a connection section coupled to and extending between said distal section and said perimeter edge wherein said distal section of said projection is configured for positioning under an arm of a user when a head of the user is supported by said main section of said pillow, said projection having a cylindrical shape and a consistent circular cross-sectional shape extending along a full length of said projection.

11. The device of claim 10, further comprising said main section being substantially rectangular.

12. The device of claim 11, further comprising said perimeter edge having a pair of longitudinal sides extending between opposed end sides.

13. The device of claim 12, further comprising said connection section extending from one of said longitudinal sides.

14. The device of claim 13, further comprising said connection section extending from said perimeter edge proximate one of said opposed end sides wherein said connection section is offset from a center of said one of said longitudinal sides.

15. The device of claim 14, further comprising said distal section of said projection extending towards said center of said one of said longitudinal sides parallel to said one of said longitudinal sides.

16. The device of claim 10, further comprising said main section and said projection being coplanar.

* * * * *